US008405555B2

(12) United States Patent
Liu

(10) Patent No.: US 8,405,555 B2
(45) Date of Patent: Mar. 26, 2013

(54) EMBEDDED UWB ANTENNA AND PORTABLE DEVICE HAVING THE SAME

(75) Inventor: Chih-Kai Liu, Taipei Hsien (TW)

(73) Assignee: Wistron Neweb Corp., Taipei Hsien (TW)

( * ) Notice: Subject to any disclaimer, the term of this patent is extended or adjusted under 35 U.S.C. 154(b) by 370 days.

(21) Appl. No.: 12/461,665

(22) Filed: Aug. 20, 2009

(65) Prior Publication Data

US 2010/0090913 A1 Apr. 15, 2010

(30) Foreign Application Priority Data

Oct. 9, 2008 (TW) ..... 97139055 A

(51) Int. Cl.
*H01Q 1/24* (2006.01)
*H01Q 1/38* (2006.01)
*H01Q 1/48* (2006.01)

(52) U.S. Cl. ..... 343/702; 343/700 MS; 343/846

(58) Field of Classification Search ..... 343/700 MS, 343/702, 846

See application file for complete search history.

(56) References Cited

U.S. PATENT DOCUMENTS 6,870,514 B2 * 3/2005 Simpson ..... 343/846
7,042,401 B2 * 5/2006 Park et al. ..... 343/700 MS
7,064,723 B2 6/2006 Schantz
7,180,464 B2 * 2/2007 Chiang et al. ..... 343/833
7,193,566 B2 3/2007 Chen et al.
7,598,913 B2 * 10/2009 Rao et al. ..... 343/700 MS
7,646,341 B1 * 1/2010 Lin et al. ..... 343/700 MS
7,889,140 B2 * 2/2011 Wong et al. ..... 343/702
2004/0160380 A1 8/2004 Simpson
2006/0066487 A1 3/2006 Park et al.

FOREIGN PATENT DOCUMENTS

CN 1855625 A 11/2006

OTHER PUBLICATIONS

V.A. Shameena, M.N. Suma, K. Raj Rohith, P.C. Bybi and P. Mohanan; "Computer Ultra-Wideband Planar Serrated Antenna With Notch Band On/Off Control"; dated Nov. 9, 2006; Electronics Letters—vol. 42, No. 23.

* cited by examiner

*Primary Examiner* — Jacob Y Choi
*Assistant Examiner* — Hasan Islam
(74) *Attorney, Agent, or Firm* — Bacon & Thomas, PLLC

(57) ABSTRACT

An embedded UWB antenna and a portable device having the same are disclosed. The embedded UWB antenna comprises a grounding element; a T-shaped radiating element having a horizontal portion comprising at least an opening for cutting off undesired frequency and a vertical portion comprising a feed point for feeding current to resonate frequency; and a plurality of sleeve elements extended from the grounding element along two sides of the vertical portion; wherein the plurality of sleeve elements and the vertical portion are substantially parallel to each other.

9 Claims, 11 Drawing Sheets

EMBEDDED UWB ANTENNA AND PORTABLE DEVICE HAVING THE SAME

BACKGROUND OF THE INVENTION

1. Field of the Invention

The present invention relates to an embedded UWB antenna and a portable electronic device having the same, specifically to an embedded UWB antenna that can excite vertical current and have an omni-direction radiation pattern and to a portable electronic device having the embedded UWB antenna.

2. Description of the Related Art

With the development of wireless communication technology, the demand for wireless communications grows with each passing day. Many electronic products equipped with wireless communication functions have been available on the market, such as mobile phones, Global Positioning Systems (GPSs), Personal Digital Assistants (PDAs), and notebooks, etc. All of them utilize wireless communication technology extensively to transmit information. Meanwhile, the demand for broad bandwidth increases as more and more information is transmitted via wireless internet.

With the development and popularization of wireless communication technology, the wireless communication technology have been developed many different band groups of operation in the prior arts, such as Ultra-Wide Band (UWB), WiMAX, WiFi, or 3G wireless communication technology, etc. Therefore, a multi-band antenna has become a future trend for the technology development to fulfill the need for wireless communications with different band groups.

Generally, the operating frequencies of UWB today are defined as follows: the first band group with 3-5 GHz; the second band group with 5-6 GHz; the third band group with 6-8 GHz; the fourth band group with 8-9 GHz; and the fifth band group with 9-10 GHz. Not every band group, however, is required to be used in practical use. Therefore, sometimes it is necessary to cut off some undesired band groups to avoid interference.

Various embedded UWB antennas with enough bandwidth have been developed. However, due to the restriction on the design of flat surfaces for embedded antennas, radiation patterns in the horizontal plane are not quite omni-directional. Therefore, it is necessary to provide a multi-band UWB antenna to solve problems with respect to omni-direction patterns.

In addition, in order to prevent some other band groups (such as WLAN with 5-6 G) being interfered by the UWB (such as 3-8 G), a flexible design of the antenna is also necessary to cut off certain frequencies and decrease interference.

SUMMARY OF THE INVENTION

In order to overcome the drawbacks of the prior art, the present invention provides an embedded UWB antenna and a portable electronic device having the same to excite vertical current and have an omni-direction radiation pattern.

An embodiment of the invention provides an embedded Ultra-Wide Band (UWB) antenna comprising a grounding element, a radiating element and a plurality of sleeve elements. The radiating element has a horizontal portion and a vertical portion. The horizontal portion and the vertical portion together form the radiating element in a substantially T shape, but the intersection of the vertical portion and the horizontal portion substantially depends on the required frequency of an antenna. The horizontal portion further comprises at least one opening for cutting off undesired band groups. The vertical portion further comprises a feed point for feeding current to resonate frequency. The plurality of sleeve elements respectively extends from the grounding element and are located on both sides of the vertical portion, wherein the plurality of sleeve elements and the vertical portion are parallel to each other (i.e., not connected).

In one embodiment of the invention, the horizontal portion is substantially perpendicular to the vertical portion to obtain a certain bandwidth, but which is not used to limit the invention. The horizontal portion can be disposed at an angle to the vertical portion rather than perpendicular to it for obtaining some other bandwidths.

An embodiment of the invention provides the plurality of sleeve elements comprising a pair of substantially identical sleeve elements respectively symmetrically located on both sides of the vertical portion. More particularly, in one embodiment, the plurality of sleeve elements comprise two substantially identical first sleeve elements respectively symmetrically located on both sides of the vertical portion. The plurality of sleeve elements can further comprise two substantially identical second sleeve elements respectively symmetrically located on the outer side (i.e. more far away from the vertical portion) of the first sleeve elements, and the second sleeve elements are substantially shorter than the first sleeve elements.

In one embodiment, at least one opening substantially comprises a strip-shaped opening to obtain band groups of 3-5 GHz and 6-8 GHz, but which is not used to limit the invention. The shape or size of the opening(s) can be used to control band groups and to cut off undesired bandwidth(s). Therefore, in another embodiment, for example, the at least one opening comprises substantially two strip-shaped openings, and the distance between the two strip-shaped openings is substantially equal to the width of the vertical portion so as to obtain a non cut-off band group of 3-10 GHz.

The above-mentioned embedded UWB antenna can be applied to a portable electronic device. Thus, an embodiment of the invention also discloses a portable electronic device comprising a wireless transmission module and the above-mentioned embedded UWB antenna. The wireless transmission module is electrically connected with the embedded UWB antenna to transmit data wirelessly.

Preferably, the portable electronic device substantially can be a mobile phone, a global positioning system, a personal digital assistant, or a notebook.

DETAILED DESCRIPTION OF THE PREFERRED EMBODIMENT

The advantages and innovative features of the invention will become more apparent from the following detailed description when taken in conjunction with the accompanying drawings.

Figure 1A:
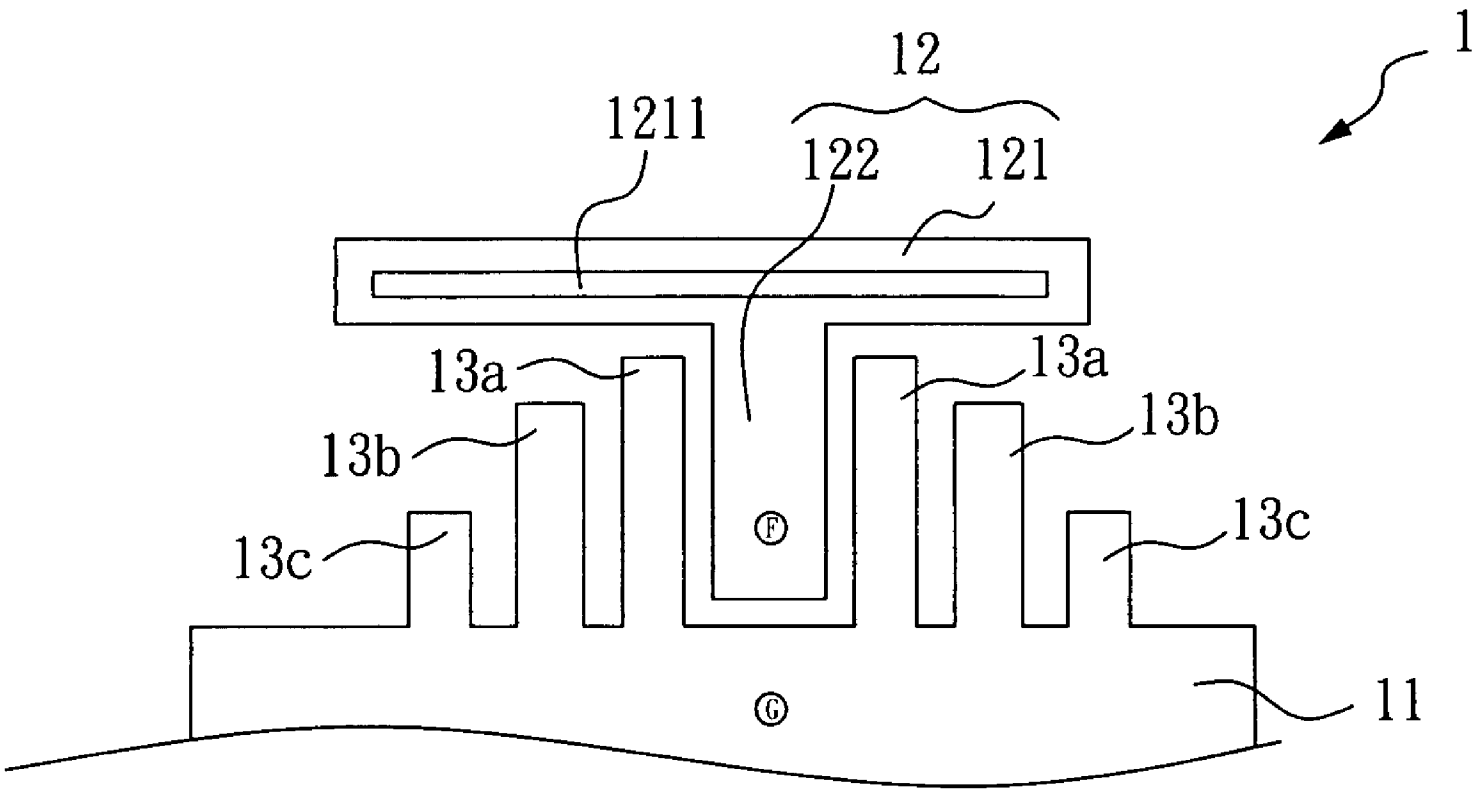
FIG. 1A is a schematic drawing of an embedded UWB antenna in accordance with one embodiment of the invention.

Please refer to FIG. 1A. An embodiment of the invention provides an embedded Ultra-Wide Band (UWB) antenna 1 comprising a grounding element 11, a radiating element 12, and a plurality of sleeve elements 13*a*-13*c*. The shape or size of the grounding element 11 can be various depending on the required frequency. The radiating element 12 has a horizontal portion 121 and a vertical portion 122. The horizontal portion 121 and the vertical portion 122 together form the radiating element 12 substantially in a T shape. The horizontal portion 121 further comprises at least one opening 1211 for cutting off undesired band groups (that will be described in more details below). The vertical portion 122 further comprises a feed point F for feeding current to resonate frequency. The plurality of sleeve elements 13*a*-13*c* respectively extends from the grounding element 11 and are located on both sides of the vertical portion 122, wherein the plurality of sleeve elements 13*a*-13*c* and the vertical portion 122 are parallel to each other (i.e., not connected with each other).

The intersection of the vertical portion 122 and the horizontal portion 121 substantially depends on the required frequency of an antenna. As shown in FIG. 1A, the left portion (i.e., on the left side of the intersection of the vertical portion 122 and the horizontal portion 121) of the horizontal portion 121 is longer than the right portion of the horizontal portion 121 so that the left portion of the horizontal portion 121 can be excited to a frequency, such as 3 GHz, and the right portion of the horizontal portion 121 can be excited to another frequency, such as 4 GHz, but which is not used to limit the invention. The left portion of the horizontal portion 121 can also be much shorter than the right portion of the horizontal portion 121 (not shown in the figures) with a different intersection of the vertical portion 122 and the horizontal portion 121, and the two excited frequencies will be reversed.

In one embodiment of the invention, as shown in FIG. 1A, the horizontal portion 121 is substantially perpendicular to the vertical portion 122 so as to obtain a certain bandwidth, but which is not used to limit the invention. The horizontal portion 121 can be disposed at an angle to the vertical portion 122 rather than perpendicular to it for obtaining some other bandwidths, which will be described in detail in other embodiments below.

In this embodiment, the invention provides the plurality of sleeve elements comprising a pair of substantially identical sleeve elements respectively symmetrically located on both sides of the vertical portion 122. More particularly, in one embodiment, as shown in FIG. 1A, the plurality of sleeve elements 13*a*-13*c* comprise two substantially identical first sleeve elements 13*a* respectively symmetrically located on both sides of the vertical portion 122. The plurality of sleeve elements 13*a*-13*c* can further comprise two substantially identical second sleeve elements 13*b* respectively symmetrically located on the outer side (i.e. more far away from the vertical portion 122) of the first sleeve elements 13, and the second sleeve elements 13*b* are substantially shorter than the first sleeve elements 13*a*. The plurality of sleeve elements of the invention can have some pairs of substantially identical sleeve elements respectively symmetrically located on both sides of the vertical portion 122 and arranged in order with a staircase shape so as to adjust frequency as desired. In this embodiment, the embedded UWB antenna 1 of the invention can be excited to a frequency of 6-7 GHz and 7-8 GHz by the sleeve elements 13*b* and the sleeve elements 13*c*, respectively.

Designers may want to cut off some band groups so as to avoid unnecessary interference (such as interference with WLAN or other band groups, etc.) so a cut-off band group can be set accordingly. In one embodiment, as shown in FIG. 1A, the opening 1211 of the invention is substantially a strip-shaped opening for cutting off a band group of 5-6 GHz, but which is not used to limit the invention. The shape or size of the opening can be used to control band groups and to cut off undesired bandwidths (which will be described in more detail shown in below).

Figure 1B:
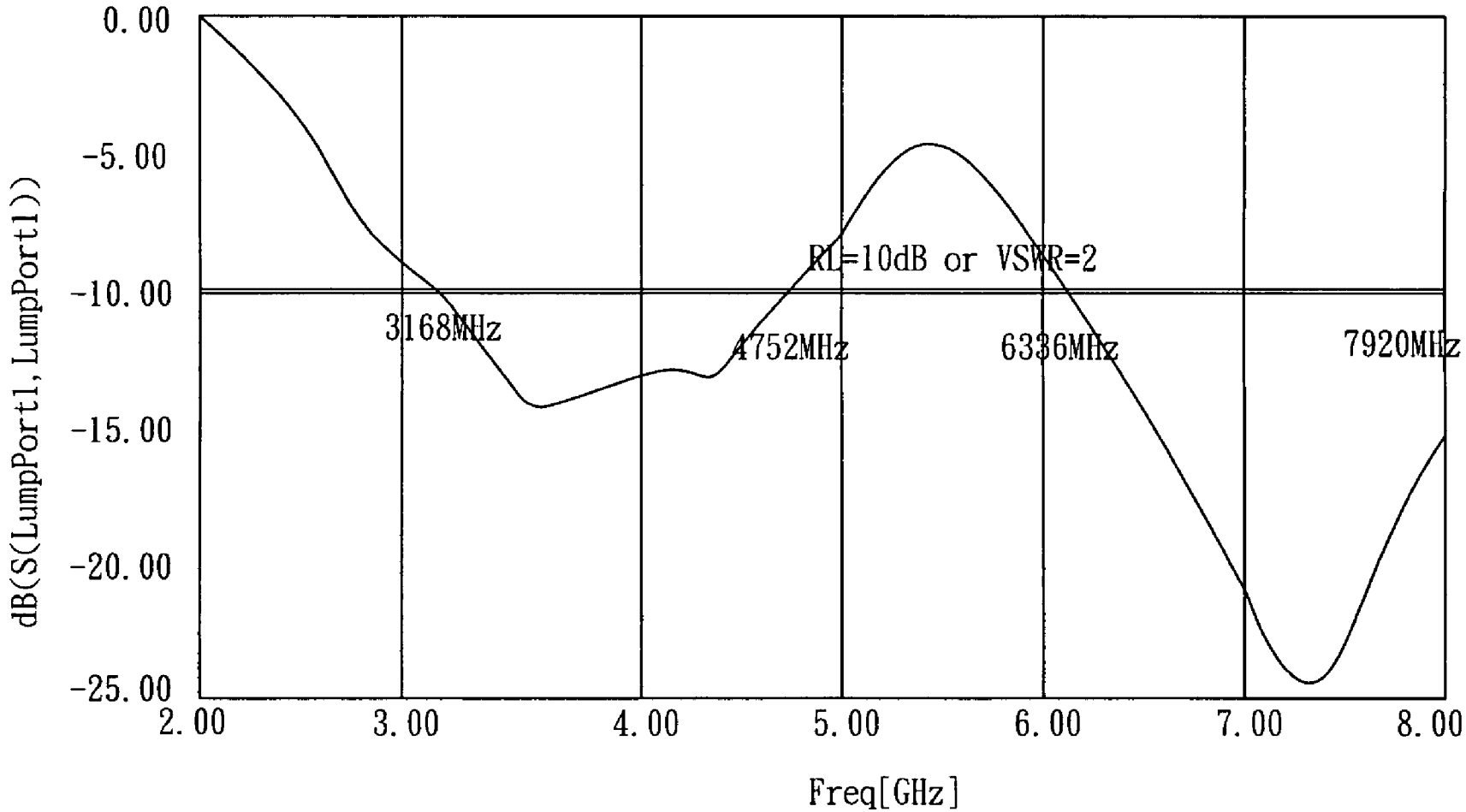
FIG. 1B illustrates the dB values at different frequencies of the embedded UWB antenna in accordance with the embodiment of the invention shown in FIG. 1A.

For example, please also refer to FIG. 1B, which illustrates the dB values at different frequencies for showing the performance of the antenna. The illustration is in accordance with the structure of the antenna shown in FIG. 1A. When Return Loss (RL) is below 10 dB (RL=10 dB can be equivalent to Voltage Standing Wave Ratio (VSWR)=2.), the corresponding band groups are 3-5 GHz and 6-8 GHz. Thus it can be seen that, in the structure of the UWB antenna as shown in FIG. 1A, a band group of 3-8 GHz of the UWB antenna can be obtained and a band group of 5-6 GHz can be cut off.

Figure 2A:
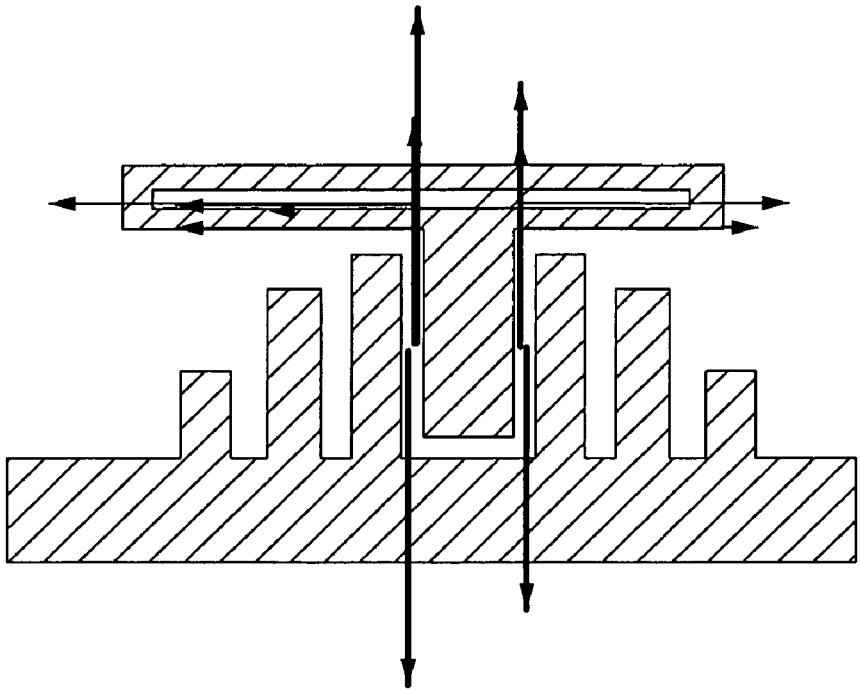
FIGS. 2A and 2B are schematic drawings of the current distribution of the embedded UWB antenna shown in FIG. 1A when the frequency is at 3.5 GHz and 4.5 G, respectively.
Figure 2B:
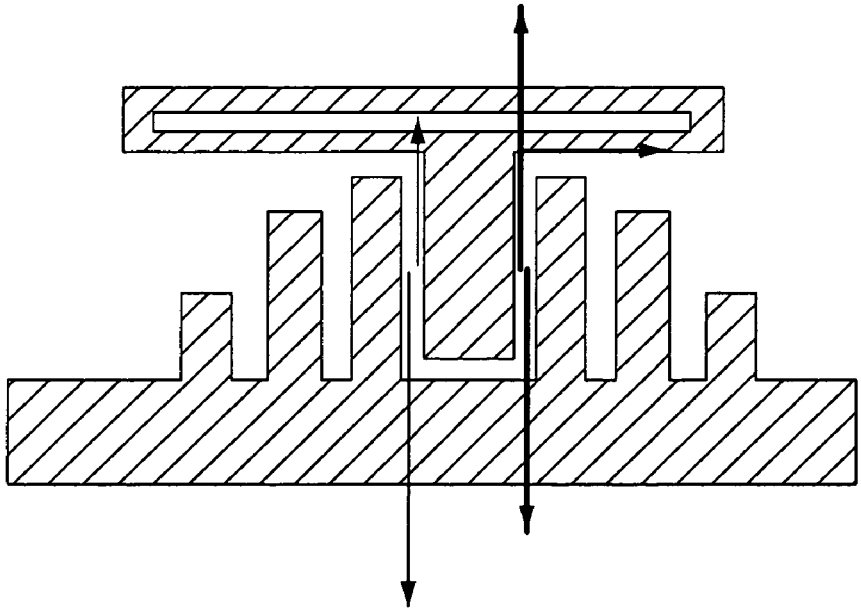
Figure 2C:
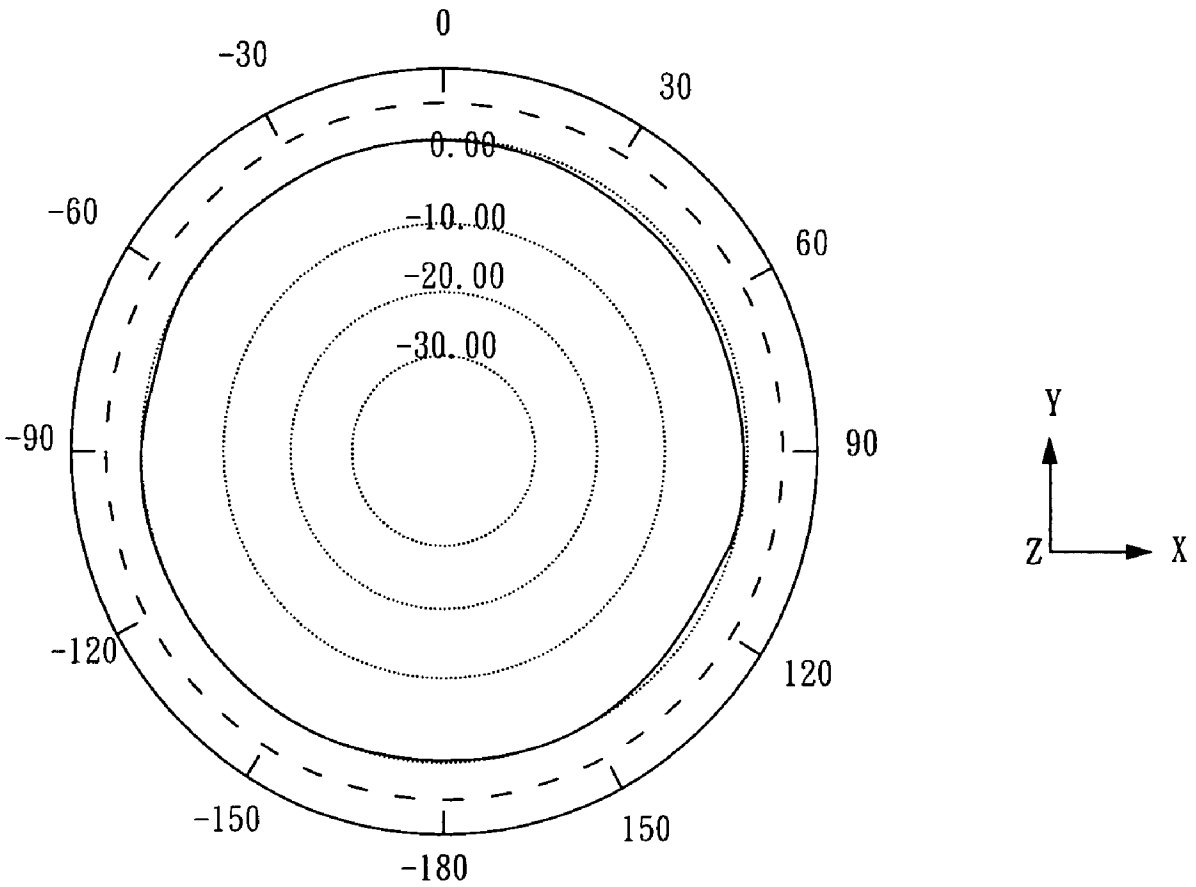
FIG. 2C illustrates a radiation pattern of the embedded UWB antenna shown in FIG. 1A with a band group of 3-5 GHz.

Furthermore, the vertical portion 12 and the sleeve elements 13*a*-13*c* are parallel to each other. The vertical portion 122 can be used for an excitation path for vertical current. The sleeve elements 13*a* on both sides of the vertical portion 122 can enhance current in the same direction. Please refer to FIGS. 2A and 2B, schematic drawings of current distribution respectively at 3.5 GHz and 4.5 G in accordance with the structure of the embedded UWB antenna 1 shown in FIG. 1A. As can be seen apparently, the embedded UWB antenna 1 of the invention can have preferable vertical current. Please also refer to FIG. 2C. Therefore, the pattern in X-Y plane is more omni-directional when the band group is at 3-5 GHz.

Figure 3A:
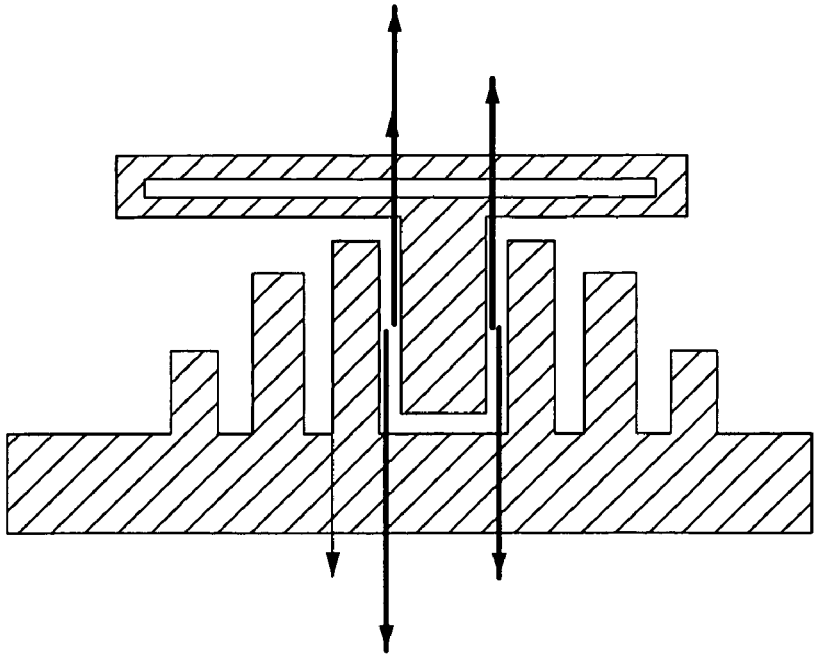
FIGS. 3A and 3B are schematic drawings of the current distribution of the embedded UWB antenna shown in FIG. 1A when the frequency is at 6.5 GHz and 7.5 G, respectively.
Figure 3B:
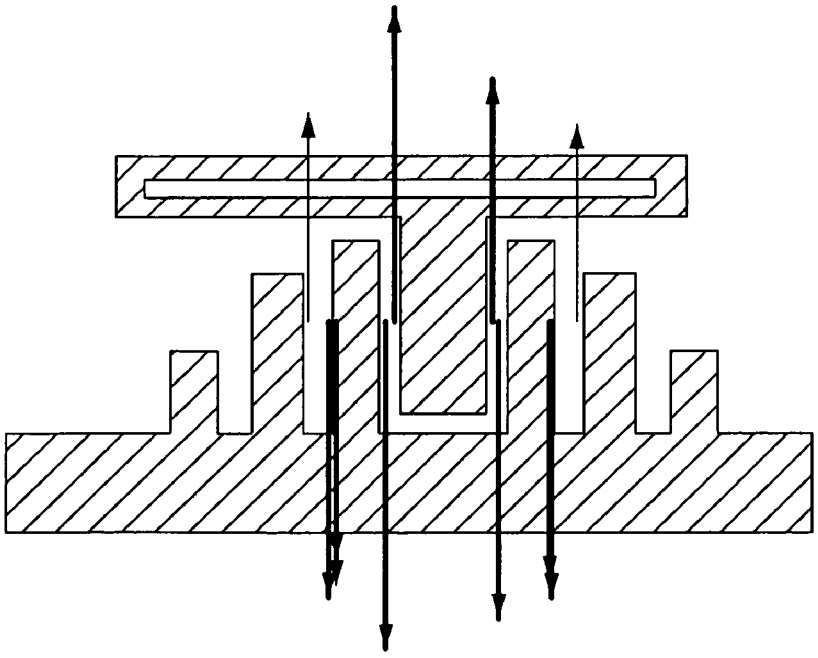
Figure 3C:
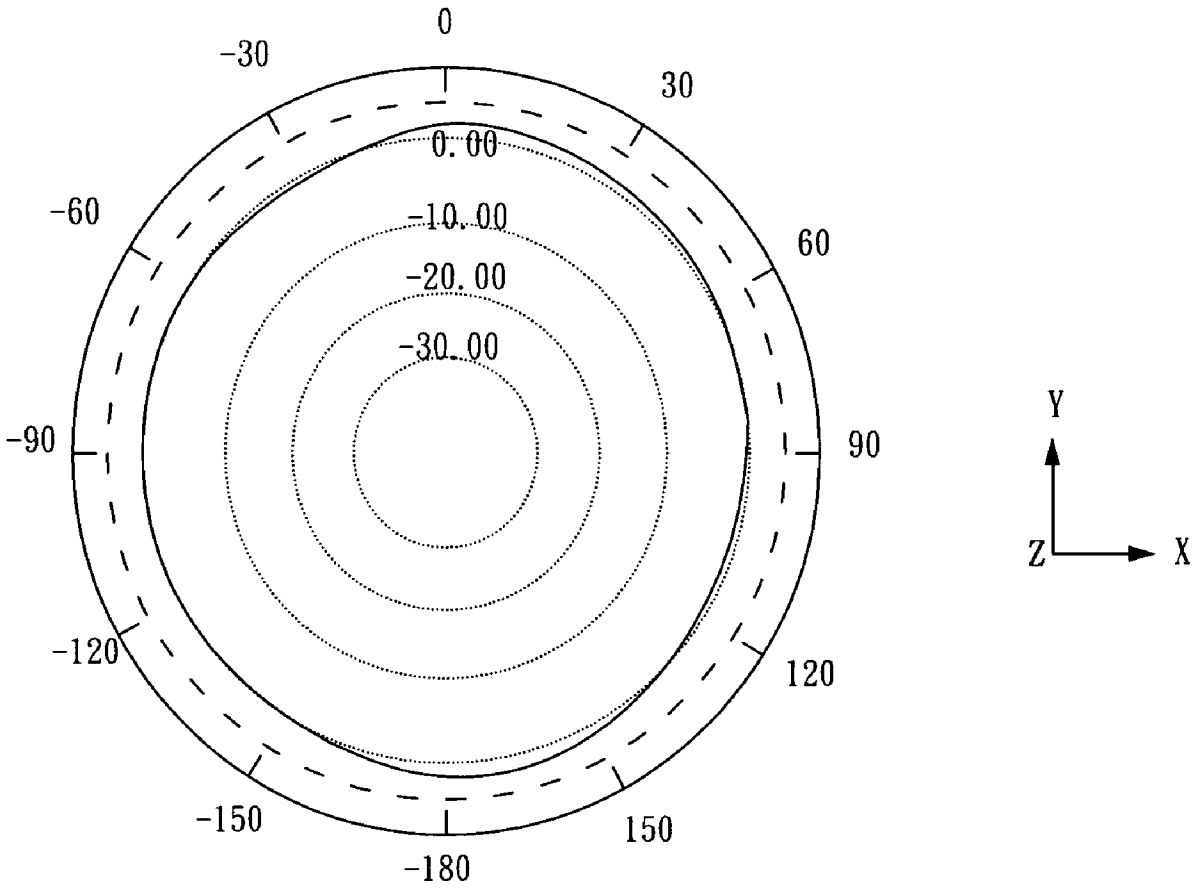
FIG. 3C illustrates a radiation pattern of the embedded UWB antenna shown in FIG. 1A with a band group of 6-8 GHz.

FIGS. 3A and 3B are schematic drawings of current distribution respectively at 6.5 GHz and 7.5 G in accordance with the structure of the embedded UWB antenna 1 shown in FIG. 1A. Apparently, the embedded UWB antenna 1 of the invention can have preferable vertical current again. Please also refer to FIG. 3C. Therefore, the pattern in X-Y plane is also more omni-directional when the band group is at 6-8 GHz.

Figure 4A:
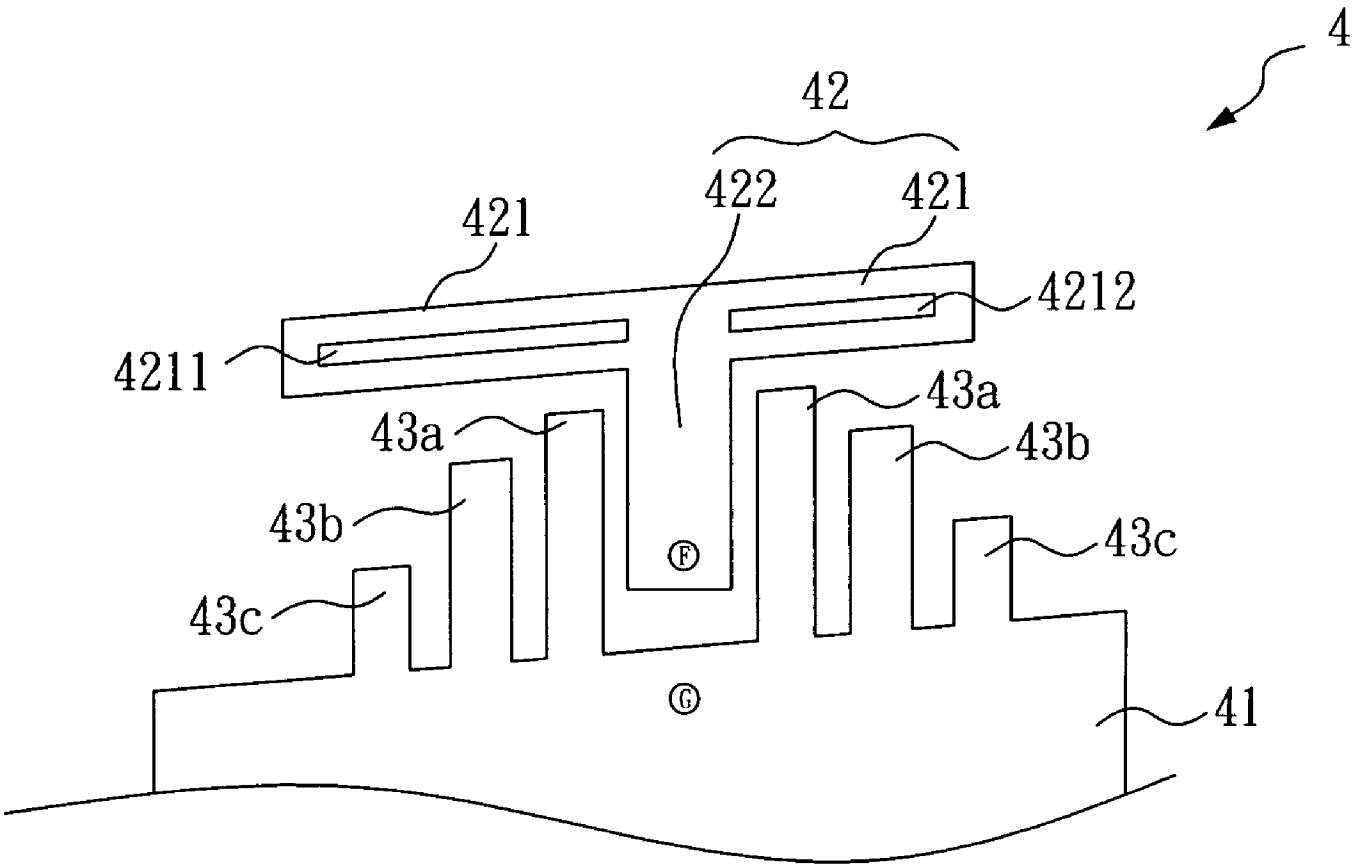
FIG. 4A is a schematic drawing of an embedded UWB antenna in accordance with another embodiment of the invention.
Figure 4B:
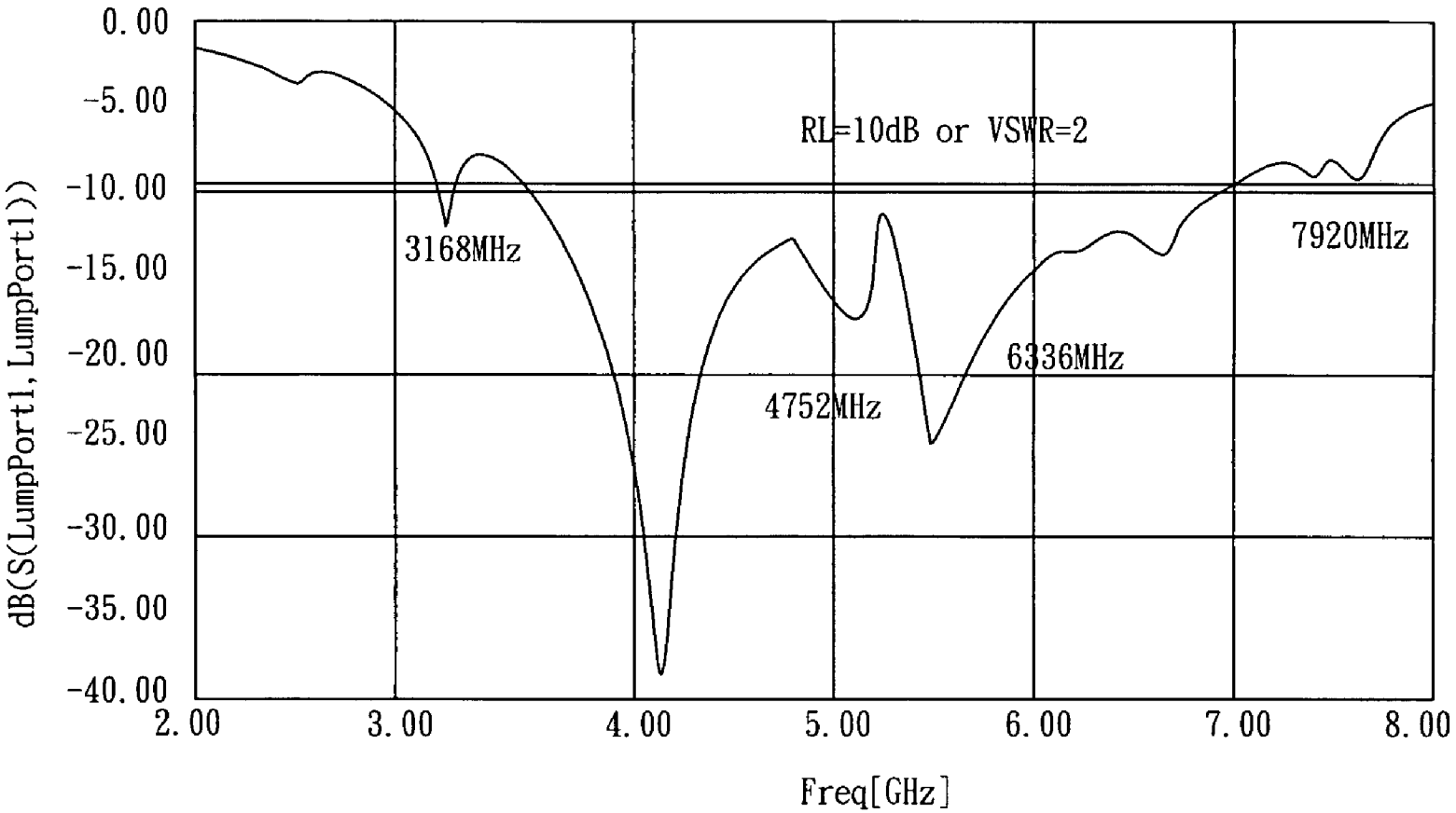
FIG. 4B illustrates the dB values at different frequencies of the embedded UWB antenna in accordance with the embodiment of the invention shown in FIG. 4A.

Although the horizontal portion 121 is perpendicular to the vertical portion 122 in FIG. 1A, this is not used to limit the invention. Please refer to FIG. 4A. As mentioned above, the horizontal portion 421 can be disposed at an angle to the vertical portion 422 rather than perpendicular to it. As mentioned above, the shape or size of the opening can be used to control band groups and to cut off undesired bandwidths. In the embodiment of FIG. 4A, the at least one opening comprises substantially two strip-shaped openings 4211, 4212, and the distance between the two strip-shaped openings 4211, 4212 is substantially equal to the width of the vertical portion 422. Please also refer to FIG. 4B, which illustrates the dB values at different frequencies. Apparently, a non cut-off band group of 3-8 GHz can be obtained in accordance with the structure of the UWB antenna shown in FIG. 4A.

Figure 5A:
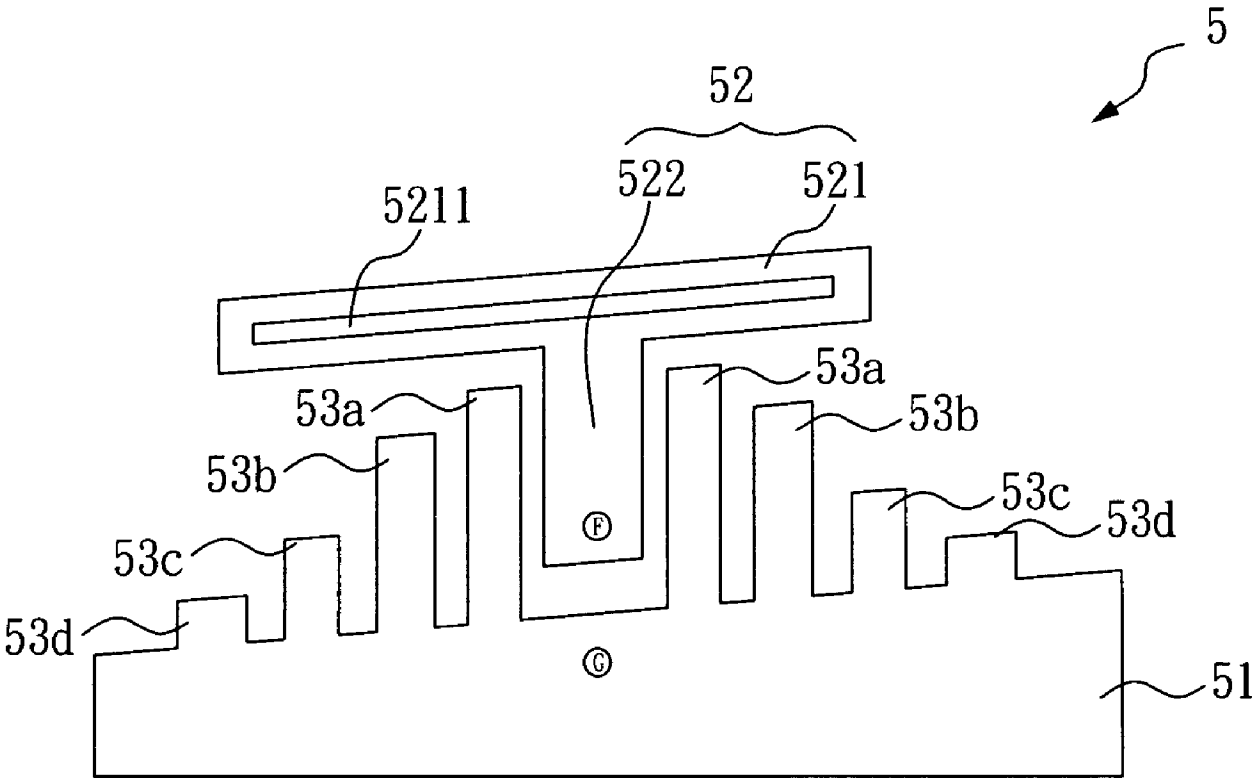
FIG. 5A is a schematic drawing of an embedded UWB antenna in accordance with the other embodiment of the invention.
Figure 5B:
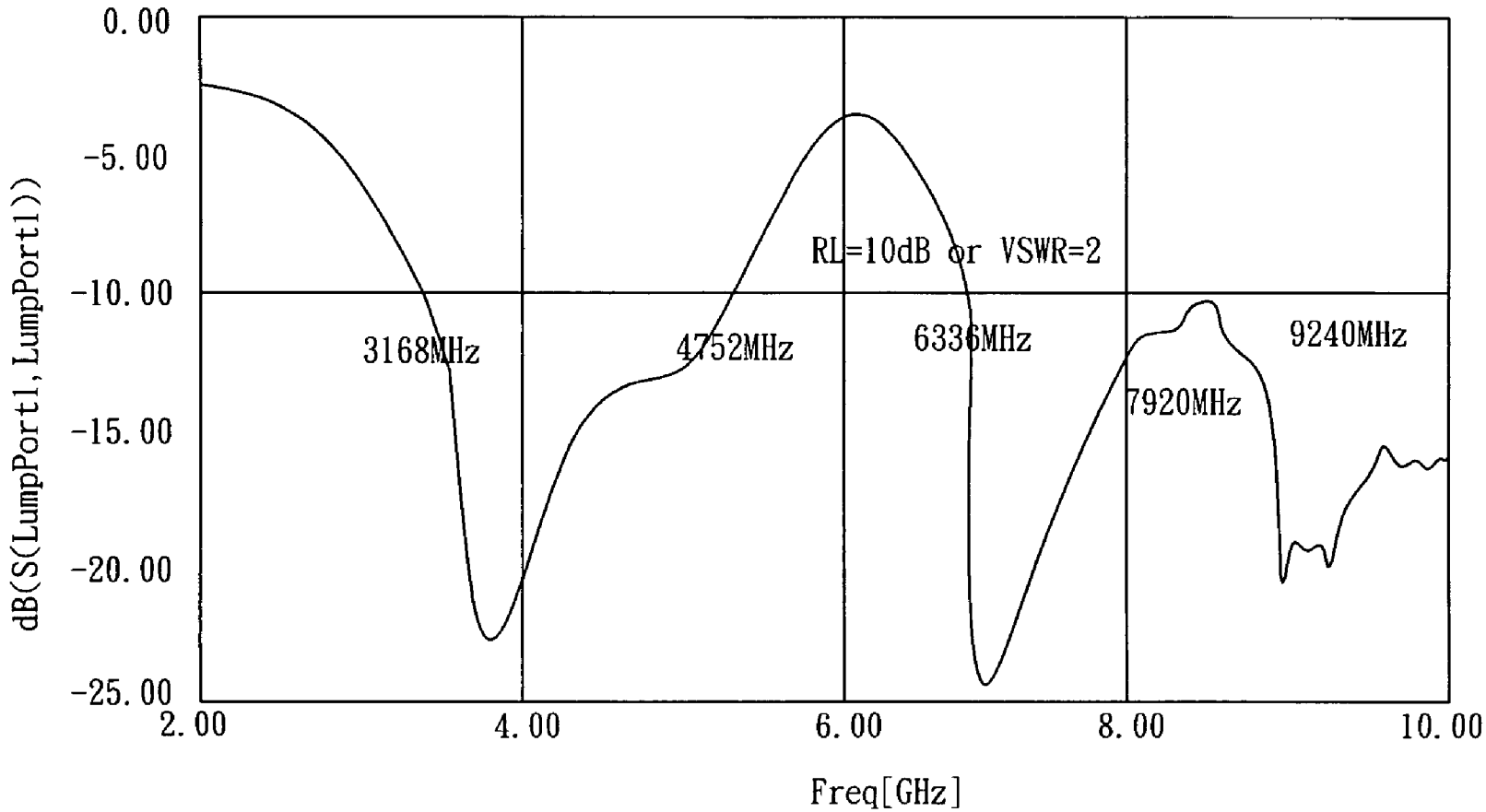
FIG. 5B illustrates the dB values at different frequencies of the embedded UWB antenna in accordance with the embodiment of the invention shown in FIG. 5A.

Please refer to FIG. 5A for another embodiment. The structure of the embedded UWB antenna 5 of this embodiment is similar to that shown in FIG. 4A. In this embodiment, the horizontal portion 521 comprises only one strip-shaped opening 5211 and one more pair of sleeve elements 53*d* comparing with FIG. 4A. It can be realized that the sleeve elements 13*a*-13*c*, 43*a*-43*c*, or 53*a*-53*d* of the invention do not have to have the same width or height. In this embodiment, the embedded UWB antenna 5 can be excited to a wide band of 10 GHz by the shorter and wider sleeve elements 53*d*. Please refer to FIG. 5B, which illustrates the dB values at different frequencies. The embedded UWB antenna 5 of this embodiment can has two ultra-wide band groups, 3-4.7 GHz and 6.3-10 GHz.

Figure 6:
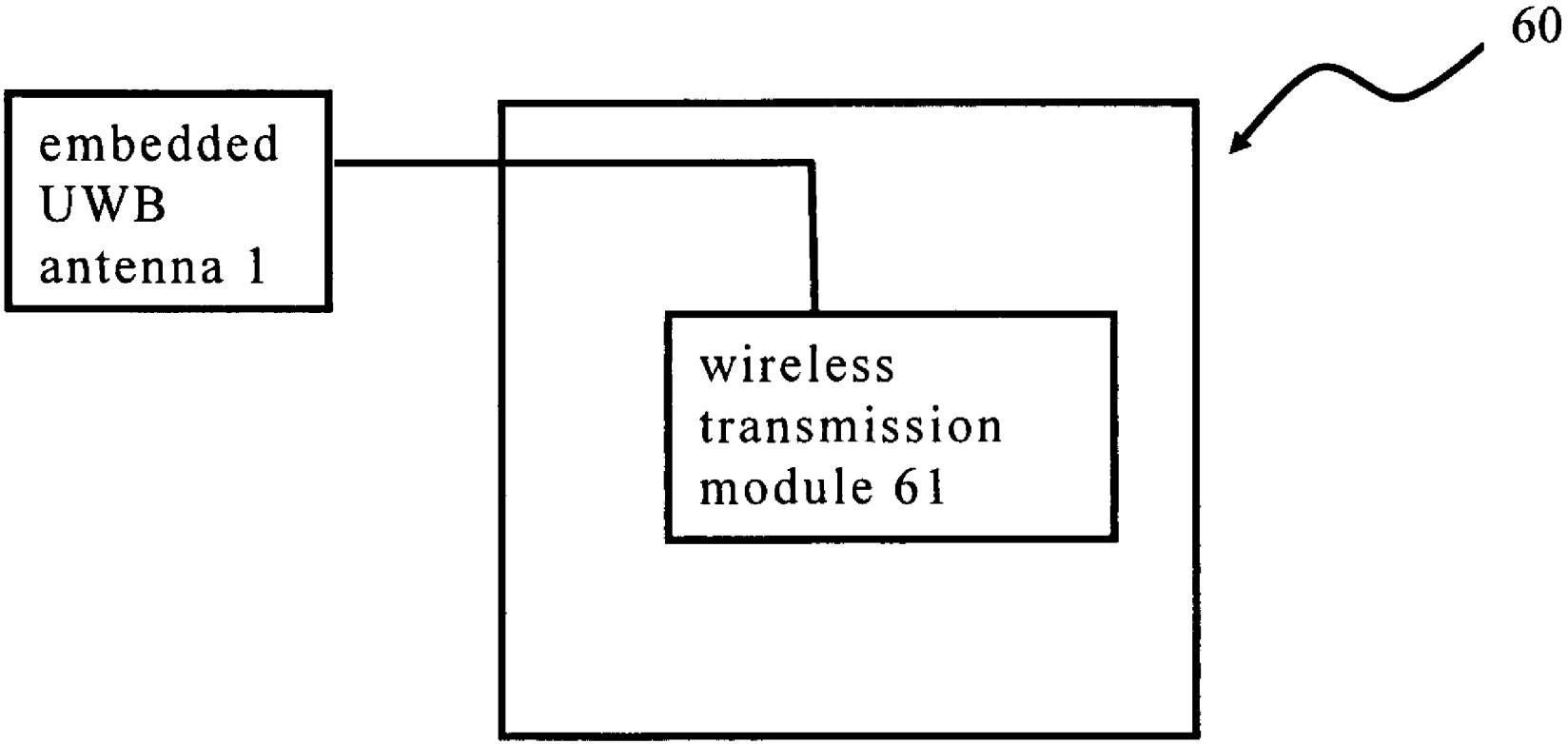
FIG. 6 is a functional block drawing of a portable electronic device in accordance with the invention.

The embedded UWB antenna 1, 4, or 5 mentioned above can be applied to a portable electronic device. In order to simplify the description, we only use the reference number 1 for the embedded UWB antenna 1 as the example. Please refer to FIG. 6. An embodiment of the invention also discloses a portable electronic device 60. The portable electronic device 60 comprises a wireless transmission module 61 and the embedded UWB antenna 1. The wireless transmission module 61 is electrically connected with the embedded UWB antenna 1 (e.g., connected by a cable, fed current through the feed point F of the embedded UWB antenna 1, and grounded at the ground point G) to transmit data wirelessly. Also, the embedded UWB antenna 4 or 5 can replace the embedded UWB antenna 1 shown in FIG. 6.

The wireless transmission module 61 can process the signals of the UWB antenna 1, 4, or 5, such as emitting or receiving signals. Therefore, the portable electronic device 60 can receive wireless signals or transmit them to other devices (not shown in figures) by using the UWB antenna 1, 4, or 5 to transmit data wirelessly. Preferably, the portable electronic device 60 can substantially be a mobile phone, a global positioning system, a personal digital assistant, or a notebook.

It is noted that the above-mentioned embodiments are only for illustration, it is intended that the present invention cover modifications and variations of this invention provided they fall within the scope of the following claims and their equivalents. Therefore, it will be apparent to those skilled in the art that various modifications and variations can be made to the structure of the present invention without departing from the scope or spirit of the invention.

What is claimed is:

1. An embedded ultra-wide band antenna comprising:

a grounding element; a radiating element comprising a horizontal portion and a vertical portion, and the horizontal portion and the vertical portion together forms the radiating element substantially in a T shape, wherein the horizontal portion further comprises at least one closed opening for cutting off an undesired band group, the horizontal portion surrounds the closed opening, and the vertical portion further comprises a feed point for feeding current to resonate frequency; and a plurality of sleeve elements respectively extending from the grounding element, wherein the plurality of sleeve elements comprise two substantially identical first sleeve elements respectively symmetrically located on both sides of the vertical portion and two substantially identical second sleeve elements respectively symmetrically located on the outer side of the first sleeve elements, the second sleeve elements being substantially shorter than the first sleeve elements, and the plurality of sleeve elements and the vertical portion being substantially parallel to each other and arranged in order of length to form a staircase shape.

2. The embedded ultra-wide band antenna as claimed in claim 1, wherein the horizontal portion is substantially perpendicular to the vertical portion.

3. The embedded ultra-wide band antenna as claimed in claim 2, wherein the at least one closed opening is substantially a strip-shaped closed opening.

4. The embedded ultra-wide band antenna as claimed in claim 1, wherein the at least one closed opening comprises substantially two strip-shaped closed openings, and the distance between the two strip-shaped closed openings is substantially equal to the width of the vertical portion.

5. A portable electronic device comprising a wireless transmission module and an embedded ultra-wide band antenna, wherein the wireless transmission module is electrically connected with the embedded ultra-wide band antenna to transmit data wirelessly, wherein the embedded ultra-wide band antenna comprises:

a grounding element; a radiating element comprising a horizontal portion and a vertical portion, the horizontal portion and the vertical portion together forms the radiating element substantially in a T shape, wherein the horizontal portion further comprises at least one closed opening for cutting off an undesired band group, the horizontal portion surrounds the closed opening, and the vertical portion further comprises a feed point for feeding current to resonate frequency; and a plurality of sleeve elements respectively extending from the grounding element, wherein the plurality of sleeve elements comprise two substantially identical first sleeve elements respectively symmetrically located on both sides of the vertical portion and two substantially identical second sleeve elements respectively symmetrically located on the outer side of the first sleeve elements, and the plurality of sleeve elements and the vertical portion being substantially parallel to each other and arranged in order of length to form a staircase shape.

6. The portable electronic device as claimed in claim 5, wherein the portable electronic device is substantially a mobile phone, a global positioning system, a personal digital assistant, or a notebook.

7. The portable electronic device as claimed in claim 5, wherein the horizontal position of the embedded ultra-wide band antenna is substantially perpendicular to the vertical portion of the embedded ultra-wide band antenna.

8. The portable electronic device as claimed in claim 7, wherein the at least one closed opening of the embedded ultra-wide band antenna comprises substantially a strip-shaped closed opening.

9. The portable electronic device as claimed in claim 5, wherein the at least one closed opening of the embedded ultra-wide band antenna comprises substantially two strip-shaped closed openings, and the distance between the two strip-shaped openings is substantially equal to the width of the vertical portion.

* * * * *